US009074415B2

(12) United States Patent
Beresford et al.

(10) Patent No.: US 9,074,415 B2
(45) Date of Patent: Jul. 7, 2015

(54) SPACER BAR FOR A MULTIPLE PANEL GLAZING UNIT AND METHOD OF MAKING A SPACER BAR AND A MULTIPLE PANEL GLAZING UNIT

(76) Inventors: Gary Paul Beresford, Larkfield (GB); Michael William Sullivan, Benijofar (ES)

( * ) Notice: Subject to any disclaimer, the term of this patent is extended or adjusted under 35 U.S.C. 154(b) by 807 days.

(21) Appl. No.: 13/264,112

(22) PCT Filed: Apr. 14, 2010

(86) PCT No.: PCT/EP2010/054896

§ 371 (c)(1),
(2), (4) Date: Jan. 3, 2012

(87) PCT Pub. No.: WO2010/119067

PCT Pub. Date: Oct. 21, 2010

(65) Prior Publication Data

US 2012/0090253 A1 Apr. 19, 2012

(30) Foreign Application Priority Data

Apr. 14, 2009 (GB) ..... 0906293.6
Aug. 13, 2009 (GB) ..... 0914169.8

(51) Int. Cl.
*E06B 3/00* (2006.01)
*E06B 3/663* (2006.01)
*E06B 3/673* (2006.01)

(52) U.S. Cl.
CPC ..... *E06B 3/66333* (2013.01); *E06B 3/663* (2013.01); *E06B 3/66304* (2013.01); *E06B 3/67326* (2013.01); *E06B 2003/66338* (2013.01)

(58) Field of Classification Search
CPC . E06B 3/663; E06B 3/66304; E06B 3/66333; E06B 3/67326
USPC ..... 428/34, 157, 192, 426; 156/109, 250; 52/786.13
See application file for complete search history.

(56) References Cited

U.S. PATENT DOCUMENTS 2,032,003 A * 2/1936 Clause ..... 65/58
2,198,578 A * 4/1940 Hazelton, Jr. et al. ..... 428/34

(Continued)

FOREIGN PATENT DOCUMENTS

DE 2746607 5/1979
DE 9411674 10/1994

(Continued)

OTHER PUBLICATIONS

Search Report dated Sep. 4, 2009, issued in related Great Britain Application No. 0906293.6.

(Continued)

*Primary Examiner* — Donald J Loney
(74) *Attorney, Agent, or Firm* — Onello & Mello, LLP

(57) ABSTRACT

A multiple panel glazing unit including at least two glass spacer bars (2) of toughened glass each having, optionally, opposite sides that are chamfered towards a common end surface (8) and which are sealed to the glass panels (22, 24) of multiple panel glazing unit by a transparent or translucent sealant (38). The use of toughened glass spacers allows the manufacture of multiple panel glazing units to meet given operating requirements, e.g. the ability to withstand externally applied forces such as varying differential air pressure of a given magnitude across the unit, with a smaller inter-glazing panel spacing than if glass spacers that are not toughened are used.

19 Claims, 3 Drawing Sheets

(56) References Cited

U.S. PATENT DOCUMENTS

| | | | | | |
|---|---|---|---|---|---|
| 3,843,472 | A | * | 10/1974 | Toussaint et al. | 428/192 |
| 5,027,574 | A | * | 7/1991 | Phillip | 52/171.3 |
| 5,260,112 | A | * | 11/1993 | Grether et al. | 428/34 |
| 5,667,897 | A | * | 9/1997 | Hashemi et al. | 428/426 |
| 5,683,764 | A | | 11/1997 | Alts | |
| 5,698,277 | A | | 12/1997 | Schueller et al. | |
| 5,974,834 | A | * | 11/1999 | Rijkens et al. | 65/104 |
| 2002/0187299 | A1 | * | 12/2002 | Jousse et al. | 428/80 |
| 2005/0167028 | A1 | | 8/2005 | Reichert | |
| 2009/0019815 | A1 | * | 1/2009 | Ensinger | 52/786.13 |

FOREIGN PATENT DOCUMENTS

| | | |
|---|---|---|
| DE | 19525263 | 3/1997 |
| GB | 2144167 | 2/1985 |

OTHER PUBLICATIONS

International Search Report dated Sep. 6, 2010, issued in related International Patent Application No. PCT/EP2010/054896.

* cited by examiner

SPACER BAR FOR A MULTIPLE PANEL GLAZING UNIT AND METHOD OF MAKING A SPACER BAR AND A MULTIPLE PANEL GLAZING UNIT

This invention relates generally to multiple panel glazing units including a number of glass panels. In particular, the present invention relates, in its various aspects, to spacer bars for use in the manufacture of such glazing units, methods for the manufacture of such spacer bars, multiple panel glazing units including such spacer bars and methods of making such multiple panel glazing units.

Multiple panel glazing units generally take the form of two or more parallel sheets of glass, ie glass panels, which have spacer bars along their outer edges to hold the glass panels the desired distance apart. A typical spacer bar is a perforated aluminium or aluminium alloy tube containing a desiccant material to adsorb any water vapour trapped between the glass panels during manufacture of the glazing unit.

An outwardly facing peripheral channel defined by the outer sides of the aluminium tube spacer bars and outwardly extending sections of the adjacent glass panels is generally filled with a sealant to form an outer seal between the glass panels and the spacer bars.

The present invention in its various aspects is as claimed in the claims.

The present invention in a first aspect provides an elongate spacer bar for a multiple panel glazing unit which is of toughened glass. This may be used in conjunction with a sealant in a multiple panel glazing unit which allows light to pass through the sides of the glazing panel. The sealant may be confined to the edges that juxtapose the panels or may extend over the entirety of the outer surfaces of the spacer bar so filling the recesses defined by the spacer bars and the glass panels with a sealant. The amount of light that can pass into the interior is increased if a transparent or translucent sealant is used.

The use of toughened glass spacers allows the manufacture of multiple panel glazing units to meet given operating requirements, eg the ability to withstand externally applied forces such as varying differential air pressure of a given magnitude across the unit, with a smaller inter-glazing panel spacing than if glass spacers that are not toughened are used.

The toughened glass spacer bar may have opposite sides that are chamfered towards a common end surface. This may be used in conjunction with a sealant at the chamfered portions, only, to seal the spacer bar in a glazing panel unit.

The present invention in a second aspect comprises a multiple panel glazing unit including at least two elongate, spacer bars fixed at opposite sides of the multiple panel glazing unit and between a pair of glass panels, each spacer bar being of toughened glass. The spacer bars may be sealed by filling the recesses defined by the spacer bars and the glass panels with a sealant.

If the spacer bars have chamfers, each spacer bar may be fixed in position by adhesive placed between the chamfers of the spacer bar and the adjacent panel, only, preferably a transparent or translucent adhesive.

The present invention in a further aspect also provides a method of making the spacer bar according to the present invention comprising the steps of providing a length of glass having a rectangular cross-section, forming the chamfered sides by use of a water jet cutter, and applying a heat treatment to toughen the spacer bar in known manners.

The present invention in a further aspect provides a method of forming a multiple panel glazing unit including the steps of providing a first and a second glazing panel and a first and a second spacer bar of toughened glass, adhering the first and second spacer bars to a common side of the first glazing panel at opposite sides of the panel and applying adhesive to the exposed sides of the spacer bars.

Where the spacer bars have chamfered sides they may be sealed in place by filling the recesses defined by the chamfered portions of spacer bars and the glass panels with a sealant.

Embodiments of the invention in its various aspects will now be described, by way of example only, with reference to the accompanying drawings, of which:

Figure 1:
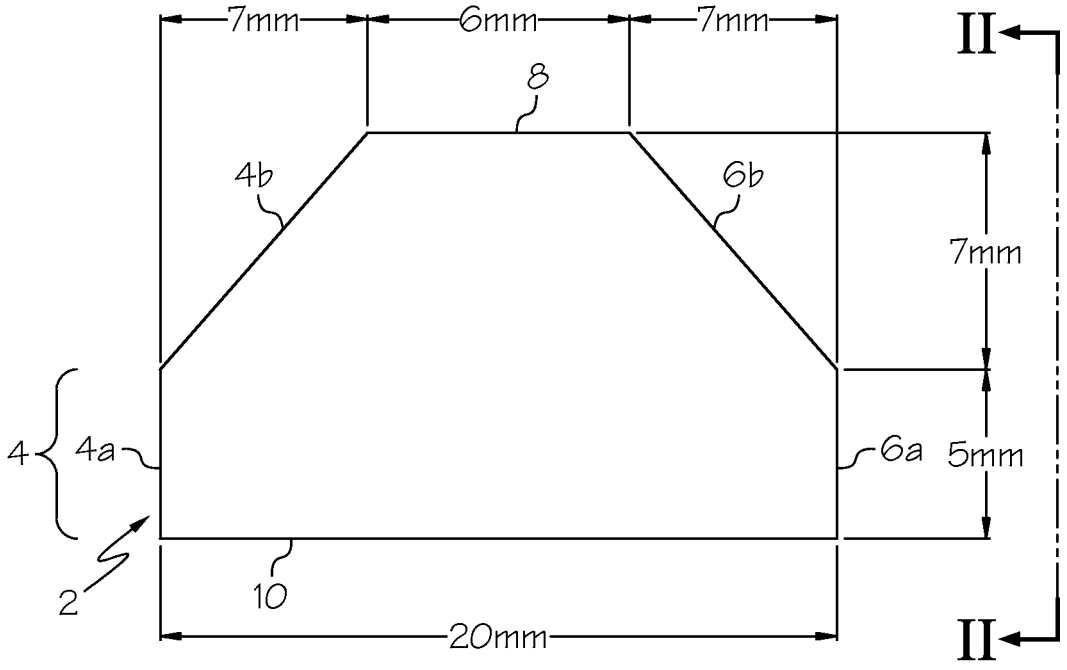
FIG. 1 is a schematic end view of a spacer bar according to the present invention.
Figure 2:
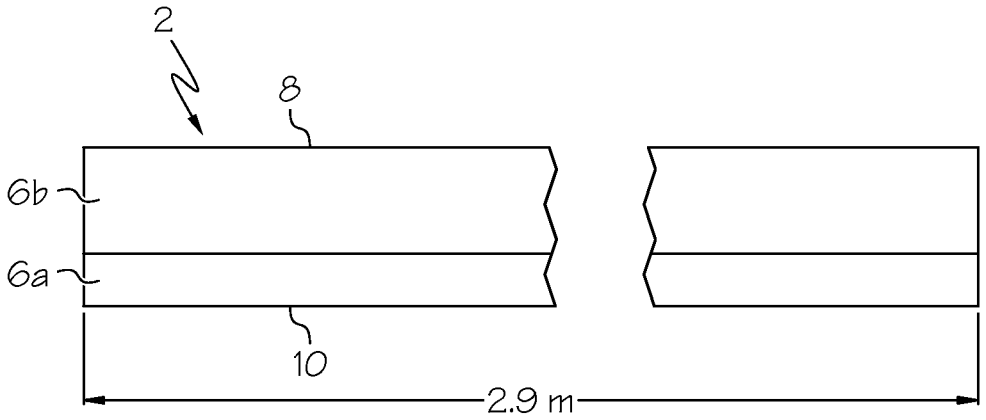
FIG. 2 is a schematic side view of the spacer bar of FIG. 1 in the direction II-II.

Referring to FIGS. 1 and 2, an exemplary embodiment of a spacer bar is in the form of an elongate toughened glass bar 2, which may be up to some 2.9 m long for some applications, with chamfered sides 4 and 6 with parallel portions 4*a* and 6*a* and inwardly chamfered portions 4*b* and 6*b*, a top surface 8 and a bottom surface 10. The width between the sides, 20 mm in this case, is selected according to the desired internal distance between the glass panels of the glazing unit. The spacer bar is 12 mm thick in this example.

An exemplary method of making spacer bar according to the present invention comprises taking a bar of non-toughened glass which has a rectangular cross-section and chamfering opposite sides to form chamfers between a top surface of the glass bar and respective edges as shown in FIG. 1. The chamfered glass bar is then heat treated to toughen the glass bar in known manner.

A double glazing unit 20 according to the present invention will now be described with reference to FIGS. 3 and 4. The glazing unit 20 includes two parallel glass panes 22, 24 of 4 mm thick toughened glass panes the sectional view being from behind the panel 22 and so is not shown. There is a pair of glass spacer bars 26 at each vertical edge (only one shown in the Figures) and a pair of aluminium spacer bars 28 with desiccant filling at the top and bottom edges (only the top one shown in the Figures). The outermost aluminium spacer bar is about 1 mm inward from the edge of the glass panels and the innermost aluminium spacer bar about 18 mm from the edge of the glass panels.

The aluminium spacer bars 28 are sealed to the glass panes 22, 24 in known manner with an adhesive tape 30, for example 1 mm thick XtraCryl 1000 polyacrylate film. The glass spacer bars 26 are fixed to the glass panels by a UV curable adhesive, eg Bondmaster UV7349 manufactured available from Bondmaster, Eastleigh Hampshire, So50 4EX, GB, and sealed to the glass panels 22 and 24 by a transparent sealant which fills the gaps between the spacer bar and glass panels 22 and 24 formed by the chamfered sections 4*b* and 6*b* of the spacer bar 26. Suitable sealant include EVERBUILD STIXALL, a chemically curving sealant and Adhesive Sealant Clear available from Winzer Wurth Industrial Ltd, Godalming GU17 1NP, GB.

An exemplary method of manufacturing the glazing unit of FIG. 3 according to the present invention will now be described. A pair of glass spacer bars is provided manufactured as described above. The two glass spacer bars 26 are located at the periphery of a glass panel 24 by means of a UV curable adhesive applied to the non-chamfered portions of the sides of the spacer bars. This acts to straighten out the glass spacer bars. A pair of aluminium spacer bars is located at opposite sides of the glass panel at its periphery by means of strips of adhesive tape. The glass and aluminium spacer bars are positioned and dimensioned to leave a peripheral channel between the glass panes 22, 24 and the spacer bars. A second glass pane is placed on top of the glass and aluminium spacer bars and adheres to them by virtue of UV curable adhesive and further lengths of adhesive tape, respectively. The weight of the top glass panels holds the components in position until the adhesive and adhesive tape sets after which the glass spacer bars are sealed to the glass panels 22, 24 by the transparent sealant.

The glazing unit may then be mounted in a between aluminium frame sections at the edges having the aluminium spacer bars. A bubble gasket may be adhered to the glass spacer bars to provide a seal to adjacent glazing units in known manner.

Figure 3:
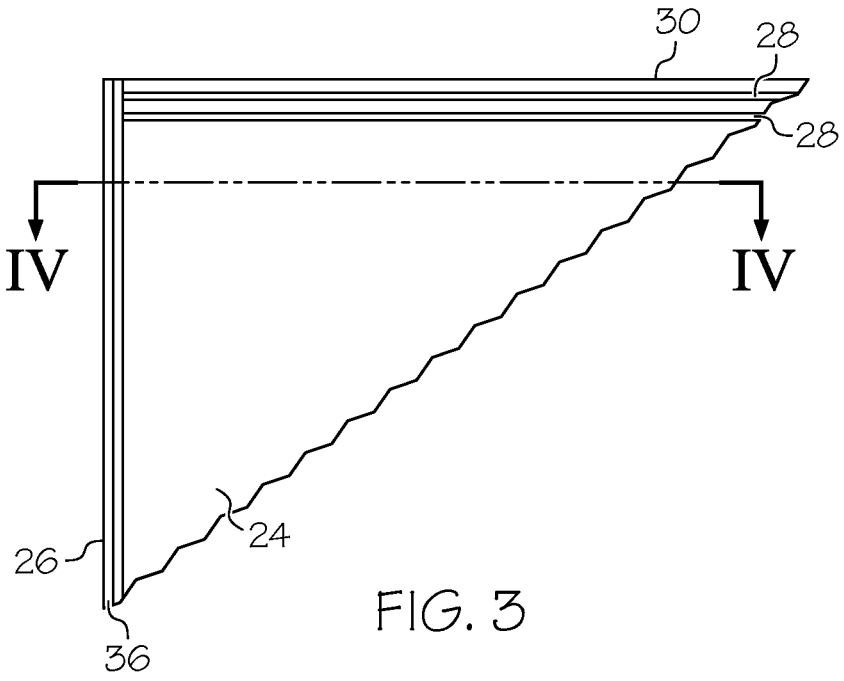
FIG. 3 is a schematic sectional part side view of a multiple panel glazing unit according to the present invention.
Figure 4:
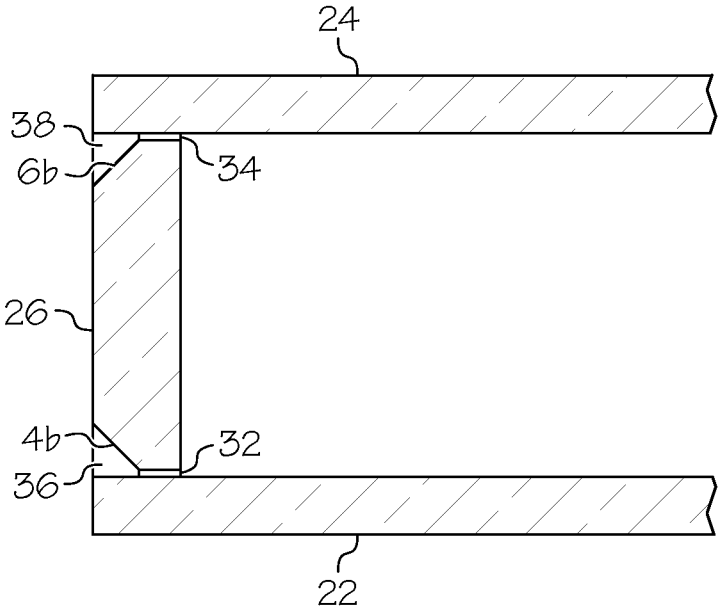
FIG. 4 is a schematic cross-sectional top view of the multiple panel glazing unit of FIG. 3 along the section line IV-IV.
Figure 5:
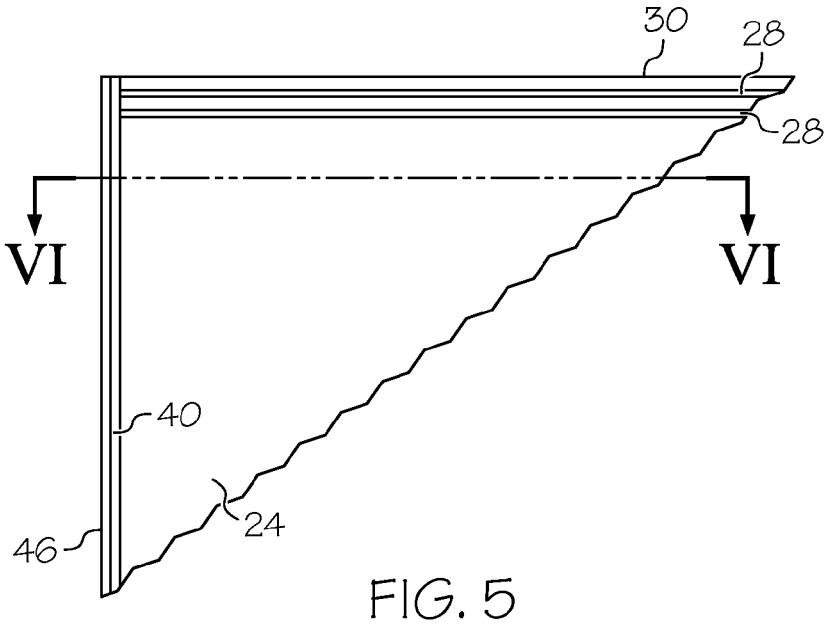
FIG. 5 is a schematic sectional part side view of a multiple panel glazing unit according to the present invention.
Figure 6:
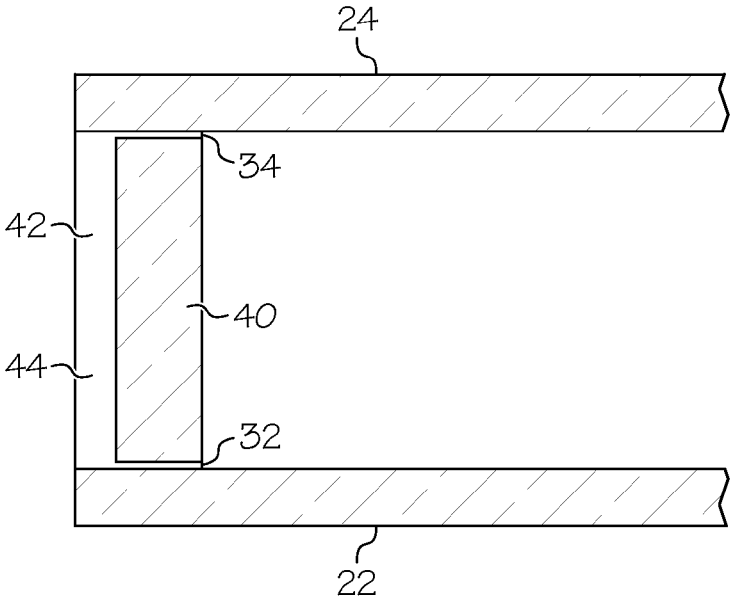
FIG. 6 is a schematic cross-sectional top view of the multiple panel glazing unit of FIG. 5 along the section line VI-VI.

The double glazing unit of FIGS. 5 and 6 is generally as shown in FIGS. 3 and 4 except it has spacer bars 40 of toughened glass which do not have any chamfers. The spacer bars 40 are stepped further back from the ends of the glazing panels 22 and 24 to define a recess 42 which is completely filled with sealant 44. The sealant 44 is used to attach a bubble gasket directly rather than using an adhesive to seal the bubble gasket to the spacer bars as in the embodiment of FIGS. 3 and 4. This simplifies the manufacturing process.

The invention claimed is:

1. A multiple panel glazing unit including at least two elongate, spacer bars fixed at opposite sides of the multiple panel glazing unit and between a pair of glass panels, each of the at least two elongate, spacer bars comprising a first material, the first material being toughened glass, and at least one spacer bar fixed along a side of the of the multiple panel glazing unit between the at least two elongate spacer bars, the at least one spacer bar comprising a second material different than the first material.

2. A multiple panel glazing unit as claimed in claim 1, each of the at least two elongate, spacer bars having opposite sides that are chamfered towards a common end.

3. A multiple panel glazing unit as claimed in claim 2, in which each glass spacer bar is fixed in position by sealant placed between the chamfers of the spacer bar and the adjacent panels.

4. A multiple panel glazing unit as claimed in claim 3, in which the sealant is transparent or translucent.

5. A multiple panel glazing unit comprising an elongate spacer bar along a first edge of the multiple panel glazing unit between a pair of glass panels, the elongate spacer bar comprising a first material, wherein the first material is toughened glass, and a spacer bar along a second edge of the multiple panel glazing unit substantially perpendicular to the first edge comprising a second material, wherein the second material is different than the first material.

6. A multiple panel glazing unit as claimed in claim 5, the spacer bar having opposite sides that are chamfered towards a common end.

7. A method of making the spacer bar of claim 6, comprising the steps of: providing a length of glass having a rectangular cross-section; forming the bevelled sides by use of a water jet cutter; and applying a heat treatment to toughen the spacer bar.

8. A method of forming the multiple panel glazing unit including the steps of: providing a first and a second glazing panel and a first and a second spacer bar each as claimed in claim 5; adhering the first and second spacer bars to a common side of the first glazing panel at opposite sides of the panel; applying adhesive to the exposed sides of the spacer bars; adhering the second glazing panel to the spacer bars; and filling the recesses defined by the spacer bars and the glass panels with a sealant.

9. A method of forming the multiple panel glazing unit including the steps of: providing a first and a second glazing panel and a first and a second spacer bar each as claimed in claim 6; adhering the first and second spacer bars to a common side of the first glazing panel at opposite sides of the panel; applying adhesive to the exposed sides of the spacer bars; adhering the second glazing panel to the spacer bars; and filling the recesses defined by the chamfered portions of spacer bars and the glass panels with a sealant.

10. The multiple panel glazing unit as claimed in claim 1, wherein the at least two elongate, spacer bars are applied to the pair of glass panels using a UV curable adhesive.

11. The multiple panel glazing unit as claimed in claim 1, wherein the pair of glass panels comprise two parallel glass panes which are 4 mm thick toughened glass panes.

12. The multiple panel glazing unit as claimed in claim 1, wherein the first material is transparent and the second material is non-transparent.

13. The multiple panel glazing unit as claimed in claim 1, wherein the second material comprises aluminium.

14. The multiple panel glazing unit as claimed in claim 1, wherein the second material comprises a desiccant filling.

15. The multiple panel glazing unit as claimed in claim 5, wherein the at least two elongate, spacer bars are applied to the pair of glass panels using a UV curable adhesive.

16. The multiple panel glazing unit as claimed in claim 5, wherein the pair of glass panels comprise two parallel glass panes which are 4 mm thick toughened glass panes.

17. The multiple panel glazing unit as claimed in claim 5, wherein the first material is transparent and the second material is non-transparent.

18. The multiple panel glazing unit as claimed in claim 5, wherein the second material comprises aluminium.

19. The multiple panel glazing unit as claimed in claim 5, wherein the second material comprises a desiccant filling.

* * * * *